US007479929B2

(12) United States Patent
Pintos et al.

(10) Patent No.: US 7,479,929 B2
(45) Date of Patent: Jan. 20, 2009

(54) BROADBAND ANTENNA AND PROCESSES FOR MANUFACTURING SUCH AN ANTENNA

(75) Inventors: Jean-François Pintos, Bourgbarre (FR); Olivier Mocquard, Rennes (FR); Jean-Luc Robert, Betton (FR); Franck Thudor, Rennes (FR); Corinne Nicolas, La Chapelle des Fougeretz (FR)

(73) Assignee: Thomson Licensing, Boulogne Billancourt (FR)

( * ) Notice: Subject to any disclaimer, the term of this patent is extended or adjusted under 35 U.S.C. 154(b) by 0 days.

(21) Appl. No.: 10/523,182

(22) PCT Filed: Jul. 21, 2003

(86) PCT No.: PCT/EP03/50325

§ 371 (c)(1),
(2), (4) Date: Oct. 23, 2006

(87) PCT Pub. No.: WO2004/013932

PCT Pub. Date: Feb. 12, 2004

(65) Prior Publication Data

US 2007/0146224 A1 Jun. 28, 2007

(30) Foreign Application Priority Data

Jul. 30, 2002 (FR) ..... 02 09640

(51) Int. Cl.
*H01Q 13/00* (2006.01)

(52) U.S. Cl. ..... 343/772; 343/773; 343/786

(58) Field of Classification Search ..... 343/772
See application file for complete search history.

(56) References Cited

U.S. PATENT DOCUMENTS

| | | | | |
|---|---|---|---|---|
| 2,239,724 | A | 4/1941 | Lindenblad | |
| 2,454,766 | A | 11/1948 | Brillouin | |
| 4,788,554 | A | 11/1988 | Smith | |
| 2004/0095286 | A1 * | 5/2004 | Lee et al. | 343/786 |

FOREIGN PATENT DOCUMENTS

| | | |
|---|---|---|
| EP | 1189305 | 3/2002 |
| GB | 2105914 | 3/1983 |

OTHER PUBLICATIONS

Search Report Dated Oct. 10, 2003.

* cited by examiner

*Primary Examiner*—Trinh V Dinh
(74) *Attorney, Agent, or Firm*—Joseph J. Laks; Robert D. Shedd; Brian J. Cromarty

(57) ABSTRACT

The present invention relates to a broadband monopole antenna comprising a "cup"-shaped radiating element mounted on an earth plane forming support of annular shape. This antenna can be used in the field of portable television apparatuses.

8 Claims, 3 Drawing Sheets

BROADBAND ANTENNA AND PROCESSES FOR MANUFACTURING SUCH AN ANTENNA

This application claims the benefit, under 35 U.S.C. § 365 of International Application PCT/EP03/50325, filed Jul. 21, 2003, which was published in accordance with PCT Article 21(2) on Feb. 12, 2004 in English and which claims the benefit of French patent application No. 0209640, filed Jul. 30, 2002.

The present invention relates to a broadband antenna, more particularly to an antenna intended for terrestrial digital reception for portable applications. It also relates to various manufacturing processes.

BACKGROUND OF THE INVENTION

Terrestrial digital television will progressively replace analogue television. One of the major issues of this transition is that of offering quality reception, even inside houses or apartments. This issue involves constraints on the size of the receiving antenna which has to be relatively compact and lightweight. Moreover, the standard used within the framework of terrestrial digital television is, in Europe, the DVB-T standard. This standard provides for the use of all the channels in the UHF band, namely the band lying between 470 MHz and 862 MHz.

Consequently, the antenna used for terrestrial digital television should have good performance over a broad band of frequencies. The constraints mentioned above naturally steer the choice of radiating element towards a travelling wave antenna. Numerous conceivable topologies exist in the known art. Thus, the antenna may be a Vivaldi, type antenna or a printed spiral antenna, etc.

However, within the framework of a broadband antenna for digital television, it may be preferable to have an antenna exhibiting an omnidirectional radiation pattern, with vertical polarization. Broadband antennas meeting these constraints currently exist on the market. Such antennas are in particular formed of a monopole of conical shape. Although these antennas allow operation over a frequency band corresponding to the UHF range, they nevertheless have the drawback of being relatively heavy since the radiating element is usually made as a single metal element. They are also relatively bulky.

SUMMARY OF THE INVENTION

Consequently, the present invention proposes a modification to the monopole-type broadband antennas described hereinabove, in such a way as to obtain a compact and lightweight antenna that can easily be made by a process of moulding or of machining of a plastic foam.

Thus, the present invention relates to a broadband monopole antenna, comprising a radiating element mounted on an earth plane forming support of annular shape. According to the invention, the radiating element has a "cup" shape made on the basis of a metallizable material. The metallizable material is either a metallizable plastic or a metallizable foam. The use of this type of material makes it possible to obtain an antenna of low weight radiating over a broad frequency band.

According to one embodiment of the present invention, the external profile of the "cup"-shaped radiating element is given by the following equations:

For $1.3 < t < 4.075$ $$x(t) = 8 + 1.9 * t * \mathrm{Cos}(t - 7)$$

$$z(t) = 2.5 + 12.5 \frac{\mathrm{Sin}(t)}{t}$$

wherein coordinates (x(t),z(t)) represents points along the profile.

Moreover, according to other characteristics, the earth plane forming support of annular shape consists of a plane circular annulus furnished at its centre with an aperture extended by a cylindrical element intended to receive the stem of the "cup"-shaped radiating element. Preferably, in order to limit the bulkiness of the assembly, the external end of the annulus is inwardly curved in such a way as to form a semi-toroidal element. This particular shape makes it possible to house electronic circuits, such as the decoder or the like, inside the support.

According to various embodiments, the earth plane forming support is made with the aid of a metallizable foam, a metallizable plastic, or a metal.

The present invention also relates to a process for manufacturing an antenna of the above type. According to this process, the "cup"-shaped radiating element is made by injection moulding of a plastic followed by the metallization of at least the exterior surface of the "cup"-shaped element.

Moreover, the earth plane forming support is likewise made by injection moulding of a plastic and metallization of at least the earth plane forming part.

Whether it be in respect of the cup-shaped radiating element or in respect of the earth plane forming support, the metallization is achieved by vacuum spraying of the metal or by an electrochemical process.

The present invention also relates to another process for manufacturing an antenna of the above type. According to this process, the "cup"-shaped radiating element is made by machining a block of plastic foam followed by the metallization of at least the exterior surface of the "cup"-shaped element. The earth plane forming support is likewise made by machining a block of plastic foam followed by the metallization of at least the earth plane forming part.

In this case, the cup-shaped element and the earth plane forming support are made by machining a single block of foam. The metallization is preferably achieved by atomization of an electrically conducting paint.

Other characteristics and advantages of the present invention will become apparent on reading the description of various embodiments, this description being given with reference to the appended drawings in which:

DETAILED DESCRIPTION

Figure 1:
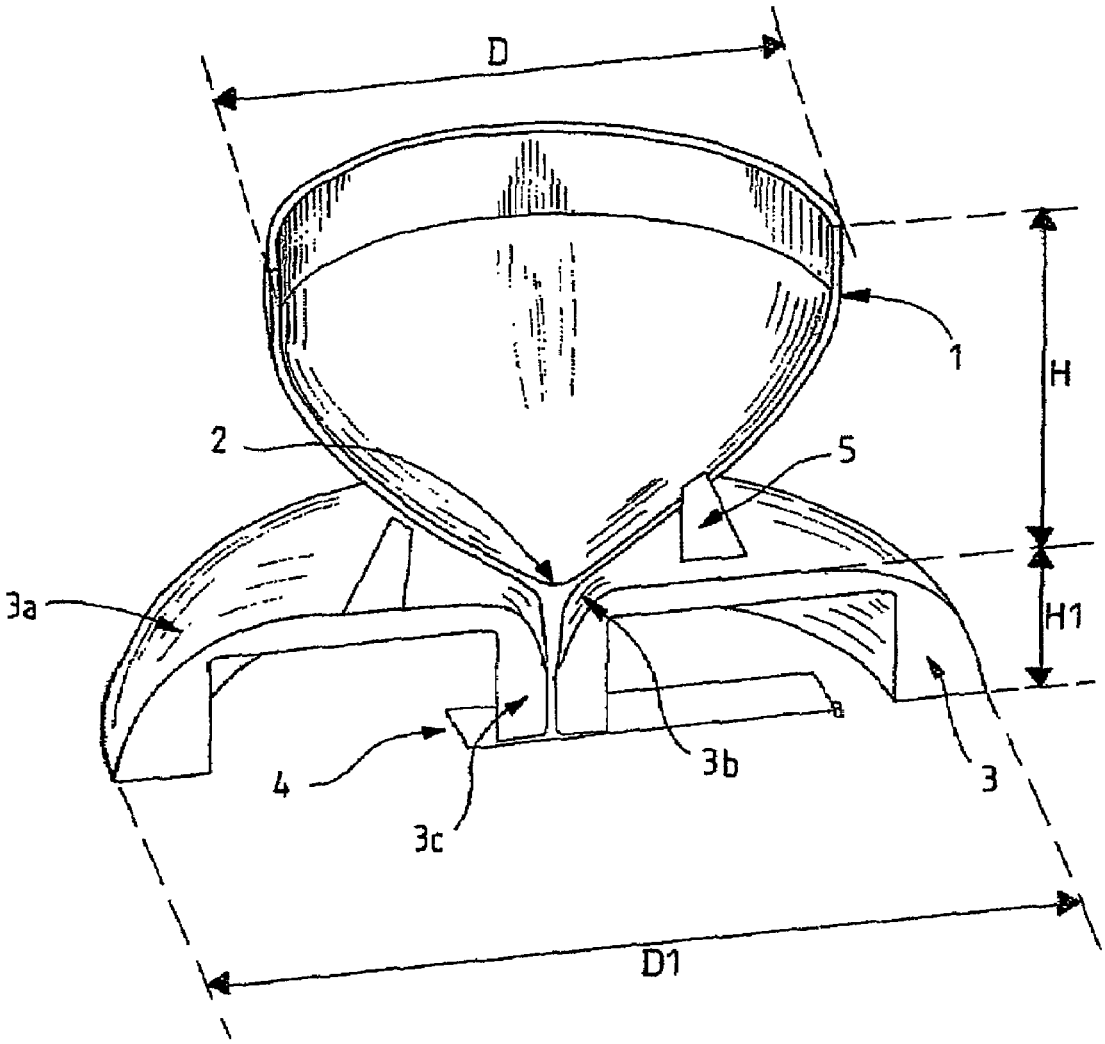
FIG. 1 is a sectional and partially perspective view of a first embodiment of an antenna in accordance with the present invention.

As represented in FIG. 1, a broadband antenna in accordance with the present invention comprises a first cup-shaped element 1 exhibiting a cup-like part proper extended by a stem 2. In the embodiment represented, the cup-shaped element is made, preferably, by injection moulding, in particular under steam pressures, of a plastic in a mould exhibiting the profile of the cup. In this case, the plastic consists of any metallizable plastic that can easily be injection moulded, such as thermoplastic polymers of the polyethylene, polypropylene or similar type. To radiate in a relatively broad frequency band, the external profile of the cup-like element is, preferably, given by the following equations:

$$\text{For } 1.3 < t < 4.075$$

$$x(t) = 8 + 1.9 * t * \text{Cos}(t - 7)$$

$$z(t) = 2.5 + 12.5\frac{\text{Sin}(t)}{t}$$

Moreover, to radiate the electromagnetic waves, the external surface of the cup-shaped element is coated with a metal such as tin-plated copper or chrome or some other known metallic material. In this case, the metallization of the plastic can be carried out using electrochemical processes or techniques such as vacuum spraying. According to one embodiment, after having sand-blasted the plastic cup-shaped support, copper is deposited chemically over a thickness of 3 μm and then a new electrochemical copper deposition is carried out over a thickness of around 10/20 μm, the whole being plated with bright tin using a chemical process.

As represented in FIG. 1, the antenna in accordance with the present invention also comprises an earth plane forming support 3. This support exhibits an annular shape and comprises a circular annulus 3*a* furnished at its centre with an aperture 3*b* for receiving the stem 2 of the cup-shaped element, this aperture being extended by a cylindrical part 3*c* allowing the mounting of the assembly on a substrate 4 described later.

Moreover, as represented in FIG. 3, in order to limit the bulkiness of the earth plane forming support, the external end of the annulus 3*a* is inwardly curved in such a way as to form a semi-toroidal element. The particular shape of the support element 3 gives, below the earth plane, a sufficient clearance to receive electronic circuits, such as a decoder, allowing the operation of the antenna.

In accordance with the present invention, the earth plane forming support may likewise be obtained by injection moulding of a metallizable plastic as described hereinabove.

As represented in FIG. 1, the assembly consisting of the cup-shaped element and the earth plane forming support is mounted on a PCB-type substrate 4 by soldering the substrate 4 to the cylindrical element 3*c* of the earth plane and by soldering the stem of the cup-shaped element to an excitation line made on the substrate 4. Moreover, to keep the cup-shaped element in place and centred, wedges 5 are mounted between the external surface of the cup-shaped element 2 and the upper part 3*a* of the support 3.

Given below are the results of a simulation obtained with an antenna as represented in FIG. 1, the profile of whose cup-shaped element has been optimized using the equation given hereinabove and whose support element of semi-toroidal shape has also been optimized in such a way that the antenna exhibits a bulkiness as given hereinafter:

Upper diameter of the cup-shaped element D=200 mm.

Height between the external surface of the cup-like element and the stem H=135 mm.

Diameter of the earth plane forming support D1=300 mm.

Height of the earth plane forming support H1=60 mm.

Figure 2:
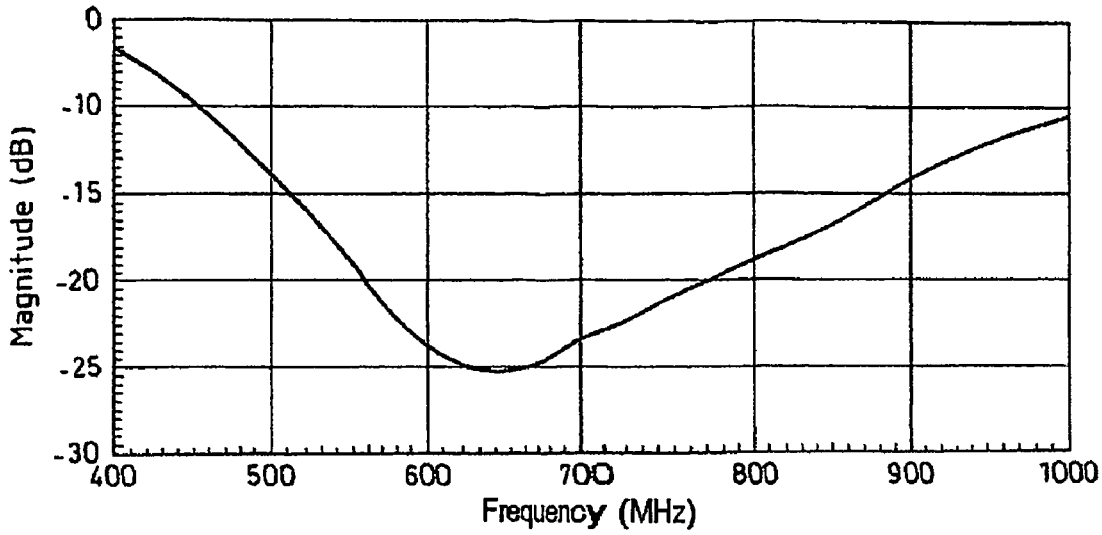
FIG. 2 is a curve giving the adaptation as a function of the frequency.

As represented in FIG. 2, an adaptation of less than −10 dB has been obtained over the whole of the UHF band, more particularly between 450 MHz and 1 000 MHz. With an antenna of this type, as represented diagrammatically in FIG. 3D, the various radiation patterns represented in FIGS. 3A, 3B, 3C have been obtained, the radiation pattern represented in FIG. 3A being that at 870 MHz, namely for the top frequency of the band, the pattern of FIG. 3B being that at 666 MHz, namely for the central frequency of the operating band and the pattern of FIG. 3C being that at 470 MHz, namely that of the bottom frequency of the operating band.

In this case, it is apparent that the radiation patterns remain relatively omnidirectional regardless of the operating frequencies.

Thus, the present invention makes it possible to obtain a very broadband antenna in the UHF band, namely the band used for TV reception, this antenna exhibiting a relatively restricted weight and bulkiness and being manufacturable at a modest cost. It can be used in particular for the reception of so-called "portable" televisions.

Figure 4:
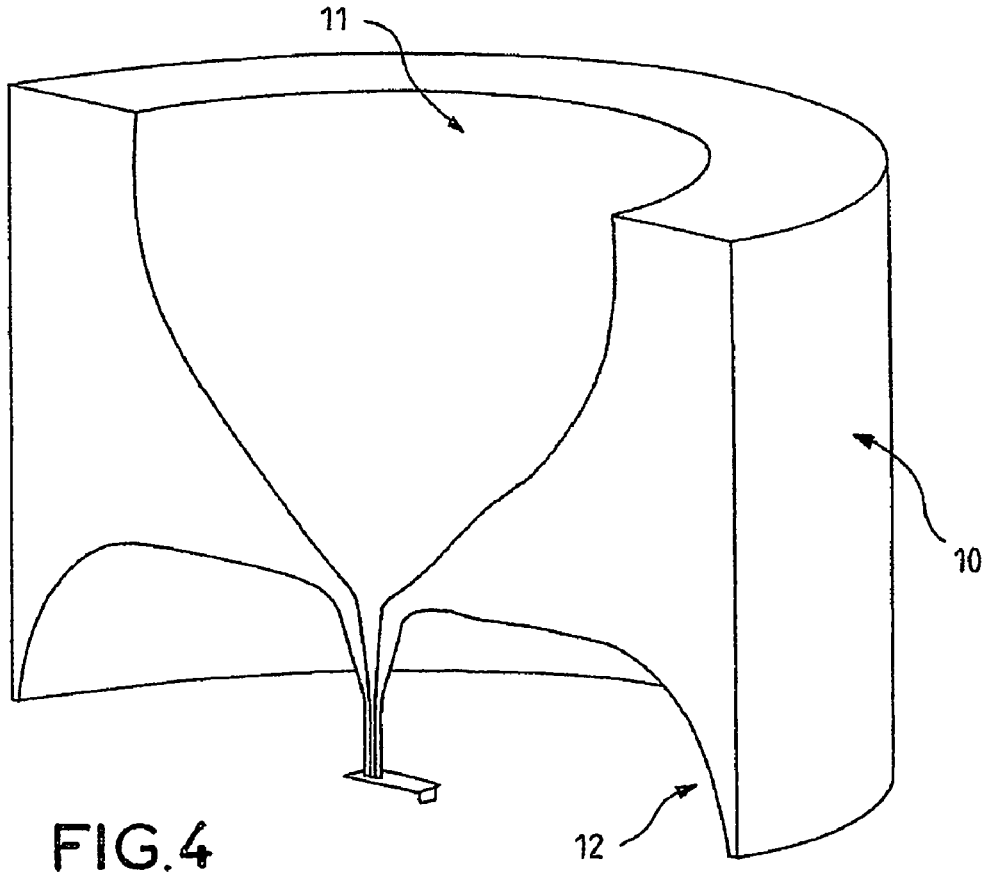
FIG. 4 is a diagrammatic sectional view of another embodiment of an antenna in accordance with the present invention.
Figure 3A:
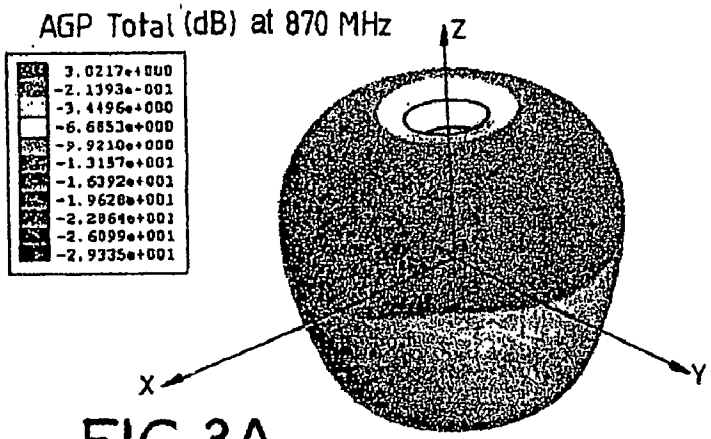
FIGS. 3A, 3B, 3C, 3D represent the radiation patterns of the antenna of FIG. 1 shown diagrammatically in three dimensions at various operating frequencies.
Figure 3B:
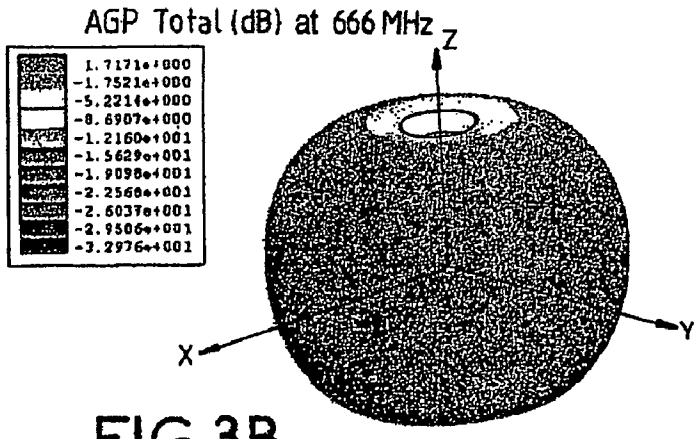
Figure 3C:
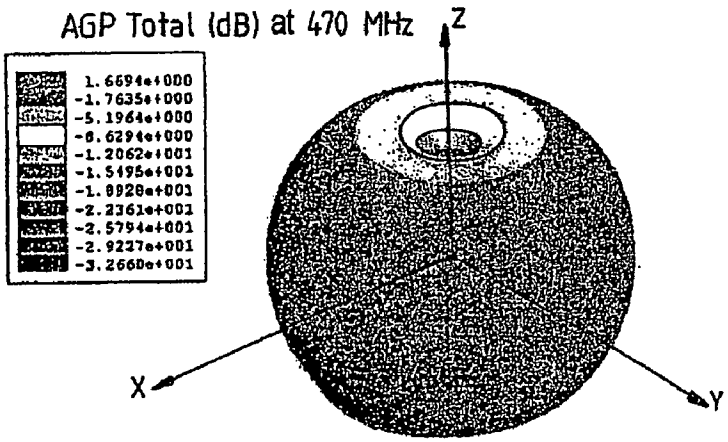
Figure 3D:
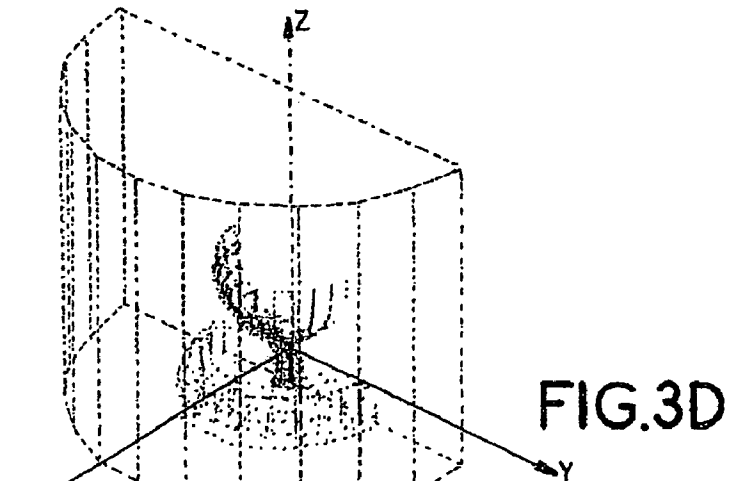

Another embodiment of an antenna in accordance with the present invention will now be described with reference to FIG. 4. In this case, the cup-shaped element 11 and the earth plane forming support element 12 are made by machining a block 10 of metallizable foam such as the plastic foams supplied by the company Rohacell under the references 51 HF or 71 HF, or expanded polystyrene foams such as that sold by EMERSON and CUMING under the reference EP5.

In this case, the metallization of the structures may be carried out by applying a metalized paint such as AL351 from PROTAVIC by atomization.

This relatively trim and compact structure enables the cup-shaped element and the earth plane forming support to be made from a single block of foam.

In this case, the excitation line is soldered to the stem of the cup-shaped element by way of a metal insert.

It is obvious to the person skilled in the art that materials and processes other than those described hereinabove may be used without departing from the scope of the claims.

The invention claimed is:

1. Broadband monopole antenna, comprising a radiating element mounted on an earth plane forming support of annular shape, wherein the radiating element is constituted by a hollow element having a "cup" shape integral with the earth plane forming support, said radiating element and said support being made on the basis of a metallizable plastic or foam, the external profile of the "cup"-shaped radiating element being given by the following equations:

$$\text{For } 1.3 < t < 4.075$$

$$x(t) = 8 + 1.9 * t * \text{Cos}(t - 7)$$

$$z(t) = 2.5 + 12.5\frac{\text{Sin}(t)}{t}$$

with t being a number varying between 1.3 and 4.075 and coordinates (x(t),z(t)) representing points along the profile.

2. Antenna according to claim 1, wherein the earth plane forming support of annular shape consists of a circular annulus.

3. Antenna according to claim 2, wherein the external end of the annulus is inwardly curved in such a way as to form a semi-toroidal element.

4. Process for manufacturing a broadband monopole antenna comprising radiating element constituted by a hollow element having a "cup" shape, said radiating element being mounted on an earth plane forming support, said process comprising a step of making the "cup"-shaped radiating element integral with the earth plane forming support by injection moulding of a plastic followed by a step of metallizing at least the exterior surface of the "cup"-shaped element and of the part forming earth plane, the profile of the "cup" shaped element being given by the following equations:

$$\text{For } 1.3 < t < 4.075$$

$$x(t) = 8 + 1.9 * t * \text{Cos}(t - 7)$$

$$z(t) = 2.5 + 12.5\frac{\text{Sin}(t)}{t}$$

with t being a number varying between 1.3 and 4.075 and coordinates (x(t),z(t)) representing points along the profile.

5. Process according to claim 4, wherein the metallization is achieved by vacuum spraying of the metal.

6. Process according to claim 4, wherein the metallization is achieved by an electrochemical process.

7. Process for manufacturing a broadband monopole antenna comprising a radiating element constituted by a hollow element having a "cup" shape, said radiating element being mounted on an earth plane, comprising a step of making the "cup"-shaped radiating element integral with the earth plane forming support by machining a single block of metallizable foam followed by a step of metallizing at least the hollow surface of the "cup"-shaped element and of the part forming earth plane, the profile of the "cup" shaped element being given by the following equations:

$$\text{For } 1.3 < t < 4.075$$

$$x(t) = 8 + 1.9 * t * \text{Cos}(t - 7)$$

$$z(t) = 2.5 + 12.5\frac{\text{Sin}(t)}{t}$$

with t being a number varying between 1.3 and 4.075 and coordinates (x(t),z(t)) representing points along the profile.

8. Process according to claim 7, wherein the metallization is achieved by atomization of an electrically conducting paint.

* * * * *